US005749486A

United States Patent [19]

Porter

[11] Patent Number: 5,749,486

[45] Date of Patent: May 12, 1998

[54] WORK PLATFORM PROVIDING REFUSE CONTAINER LID

[76] Inventor: Scott D. Porter, 1872 Stoddard Rd., Richmond, Mich. 48062

[21] Appl. No.: 682,934

[22] Filed: Jul. 8, 1996

[51] Int. Cl.[6] ..... B65D 21/02

[52] U.S. Cl. ..... 220/23.86; 220/735; 220/736; 220/761

[58] Field of Search ..... 220/570, 574, 220/694, 23.86, 735, 736, 761

[56] References Cited

U.S. PATENT DOCUMENTS

| | | | |
|---|---|---|---|
| D. 300,974 | 5/1989 | Dewing . | |
| 5,058,737 | 10/1991 | Patterson et al. | 220/574 |
| 5,060,820 | 10/1991 | Boerner | 220/574 |
| 5,240,136 | 8/1993 | Patterson et al. | 220/574 |
| 5,292,028 | 3/1994 | Patterson et al. | 220/574 |
| 5,381,921 | 1/1995 | Bray et al. . | |
| 5,553,701 | 9/1996 | Jerecki et al. | 220/570 |

*Primary Examiner*—Joseph M. Moy
*Attorney, Agent, or Firm*—Peter D. Keefe; William D. Blackman

[57] ABSTRACT

A lid for a refuse container which is structured to provide a work platform thereover. The lid includes a platform member which is configured to coverably span the mouth of a refuse container and over-extend therearound in cantilever fashion. The platform member is generally planar, having an upper surface and an opposite lower surface, and is dimensioned, in consonance with the material thereof, to provide a stable work platform at the upper surface when the lower surface is placed coveringly upon the mouth of a refuse container. The lid further includes an interface member which projects substantially perpendicular from the lower surface to thereby either snappingly or frictionally engage the sidewall of the refuse container at its mouth. The perimeter of the platform member at the upper side thereof is provided with a raised lip for restraining loose articles from inadvertently robing off, or otherwise falling from, the upper surface. A receptacle seat to be provided in the upper surface of the platform member and for a pivotally connected handle to be seatably receivable therein, whereby the handle is pivotable so as to be disposed flush with the upper surface when not in use. The refuse container may be conventional or be uniquely structured for use with the lid.

18 Claims, 1 Drawing Sheet

WORK PLATFORM PROVIDING REFUSE CONTAINER LID

BACKGROUND OF THE INVENTION

1. Field of the Invention

The present invention relates to refuse containers, and more particularly to lids which coveringly interface therewith. Still more particularly, the present invention relates to a lid for a refuse container, wherein the lid is configured to provide a work platform above a refuse container to which it is attached.

2. Description of the Prior Art

Refuse containers are quite ubiquitous. Generally, a refuse container is composed of a sidewall having a closed, generally flat bottom and an open mouth opposite the bottom, wherein refuse is deposited trappingly thereinto through the mouth. The sidewall may be cylindrical, rectangular or some other geometric shape. Lids for refuse containers are configured to cover the mouth and interfit with the sidewall at the mouth to thereby hold the lid onto the refuse container until acted upon liftably by a user. The interfit of a lid to its refuse container generally involves a perimeter rim which projects substantially perpendicular from an underside of the lid for engaging, either snappingly or frictionally, the sidewall at or adjacent the mouth. Refuse containers and there respective lids may be constructed of any suitable material, such as for example aluminum or plastic.

It is a frequently encountered problem in work areas, such as at industrial manufacturing plants, commercial shops (such as for example auto repair or woodworking facilities) and at home, that finding a free work platform is, more often than not, impossible, scarce or inconveniently located. Generally, a work platform is an elevated place upon which tools, articles or a workpiece may be placed, or a workpiece may be operated upon. For example, a table top provides an elevated work platform upon which wood may be cut, a fender may be painted, or hardware may be placed awaiting future usage.

In view of the scarcity of suitable work platforms and the ubiquitousness of refuse containers, it would be extremely beneficial if somehow a lid could be devised which would provide a work platform over a refuse container.

SUMMARY OF THE INVENTION

The present invention is a lid for a refuse container which is structured to provide a work platform thereover.

The lid according to the present invention includes a platform member which is configured to coverably span the mouth of a refuse container and, preferably, over-extend therearound in cantilever fashion. The platform member is generally planar, having an upper surface and an opposite lower surface, and is dimensioned, in consonance with the material thereof, to provide a stable work platform at the upper surface when the lower surface is placed coveringly upon the mouth of a refuse container. The lid further includes an interface member which projects substantially perpendicularly from the lower surface, forming a closed loop having a shape corresponding to the shape of the mouth (which may by round, rectangular or some other shape) to thereby either snappingly or frictionally engage the sidewall of the refuse container at its mouth.

Preferably, the perimeter of the platform member at the upper side thereof is provided with a raised lip for restraining loose articles from inadvertently rolling off, or otherwise falling from, the upper surface. Further, it is preferred for a receptacle seat to be provided in the upper surface of the platform member and for a pivotally connected handle to be seatably receivable therein, whereby the handle is pivotable so as to be disposed flush with the upper surface when not in use and perpendicularly disposed above the upper surface when being grasped to lift the lid off from the mouth of a refuse container.

Accordingly, it is an object of the present invention to provide a lid for a refuse container which provides a work platform thereabove when coveringly disposed at the mouth thereof.

These, and additional objects, advantages, features and benefits of the present invention will become apparent from the following specification.

DETAILED DESCRIPTION OF THE PREFERRED EMBODIMENT

Figure 1:
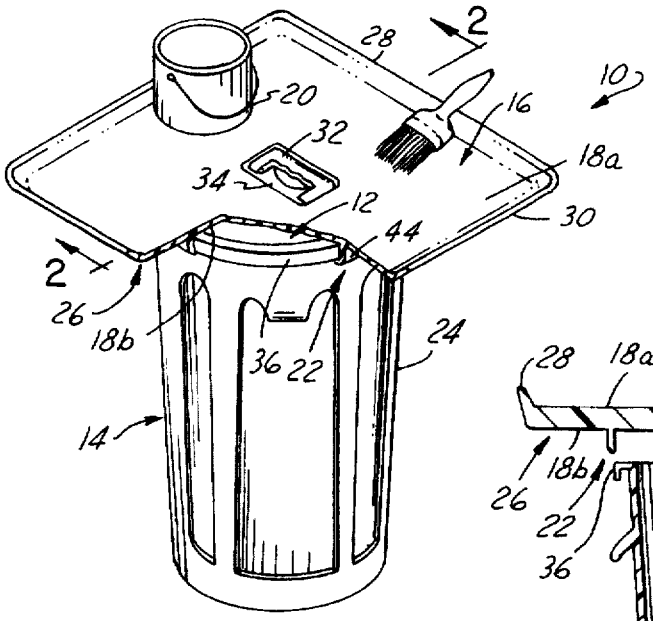
FIG. 1 is a perspective view of a lid according to the present invention, shown in operation disposed at the mouth of a refuse container and serving as a work platform with respect to various articles.

Referring now to the Drawing, FIG. 1 shows the lid 10 according to the present invention in operation covering the mouth 12 of a refuse container 14. The lid 10 includes a platform member 16 which is generally planer, having an upper surface 18*a* and an opposite lower surface 18*b*. The upper surface 18*a* serves as a work platform for supporting articles 20 of a general nature, which may include loose items, tools, workpieces, or other things. The lower surface 18*b* is provided with an interface member 22 which interfits with the sidewall 24 of the refuse container at the mouth 12 thereof. Preferably, the lid 10 has an overhang 26 of the platform member 16 which overhangs the sidewall 24 at the mouth 12 to thereby provide a work platform area at the upper surface 18*a* which is much larger than the area of the mouth. Preferably further, a raised lip 28 is provided along the periphery 30 of the upper surface 18*a* to prevent articles from accidentally failing off of the upper surface. A 32 handle is pivotally connected with a receptacle seat 34 formed in the upper surface 16.

Referring now in addition to FIGS. 2 through 5, the structure and function of the lid 10 and the refuse container 14 to which it is interfacingly operable will be detailed with greater specificity.

The sidewall 24 (inclusive of the bottom) of the refuse container 14 provides a defined space for holding refuse or other things, wherein deposits are made through the mouth 12. The sidewall 24 is typically composed of continuously formed material, such as metal or plastic, but may be composed of reticulated material. Conventionally, the sidewall 24 of the refuse container 14 adjacent the mouth 12 interfaces with a conventional lid for covering the mouth and thereby preventing items from exiting the refuse container (or rain or snow from entering thereinto). In this regard, as mentioned hereinabove, the conventional lid has a depending rim which slips over the sidewall 24 at the mouth 12. To provide more than a mere frictionally held interfit between the rim of a conventional lid and the sidewall of a refuse container, the sidewall and/or the rim of the conventional lid may be provided with one or more ribs, an inverted U-shape, or some other snap-fit providing structure. Accordingly, the refuse container 14 for use with the lid 10 according to the present invention may have any suitable lid rim interfacing structure, wherein an inverted U-shape top 36 being shown in FIGS. 1, 2 and 3 by way of illustrative example, and not limitation. While the refuse container 14 may be conventional, it may also be uniquely structured to be used exclusively with the lid 10 according to the present invention.

The lid 10 according to the present invention is composed of a durable material, such as for example rubber or plastic. The thickness T (see FIG. 3) of the platform member 16 is preferably much thicker than that of a conventional lid in order to ensure sufficient rigidity of the platform member so that it can serve as a stable work platform, even at the overhang. For example, in the case of a plastic or rubber composition of the platform member 16, a preferred thickness is on the order of about one-quarter of an inch to one inch or more. The selected thickness T for the platform member 16 depends upon the structural strength and inherent resistance to bending of the material used for the lid 10, wherein the thickness selected provides a substantially rigid work platform for stably supporting objects of liftable weight which are placed anywhere upon the upper surface 18*a* when the lower surface 18*b* is interfitted with the sidewall 24 coveringly at the mouth 12 of a refuse container 14.

The overhang O (see FIG. 2) is defined by the difference between the cross-section of the periphery 30 and the cross-section of the interface member 22 (ie., the rim 44). The length of overhang O (see FIG. 2) which is possible depends upon the strength of the platform member to resist bending when objects are placed thereupon near the periphery 30 and the tendency of the refuse container to tip, which tendency is related to the ratio of the cross-section of its sidewall 24 at the bottom thereof to the cross-section of the platform member 16, as well as the weight, distribution and proximity to the raised lip 28 of articles 20 placed upon the platform member, as well as the weight of any articles in the refuse container (which if relatively heavy and having a low center of gravity with respect to the refuse container, will tend to keep the refuse container from tipping).

By way of illustrative example, for a cylindrically shaped refuse container having a cross-section of about 24 inches, the lid 10 has a platform member 16 having a square cross-section of about 40 inches by 40 inches, wherein the overhang O ranges from about 8 inches to about 16 inches.

The periphery 30 of the lid 10 may be any selected shape, such as for example a square shape, as shown, or any other geometrical shape, such as for example a circular shape. The shape of the periphery 30 may or may not correspond to the shape of the sidewall 24 of the refuse container 14 at the mouth 12 thereof. For example, as shown at FIG. 1, a round shaped sidewall 24 may interface with a square shaped lid 10.

Preferably, the upper surface 18*a* of the platform member 16 is flat so that objects placed thereupon sit stably without tending to tip or roll. The aforementioned raised lip 28 is formed integrally with the platform member 16 at the periphery 30 thereof. The raised lip 28 is structured to prevent loose items from rolling off or otherwise falling off the upper surface 18*a* of the platform member 16. Further, the raised lip 28 serves to retain any liquids present on the upper surface 16*a* from running thereof.

At the geometrical center of the platform member 16 is the hereinabove mentioned handle 32. The handle 32 is receivable into a receptacle seat 34 that is recessed into the upper surface 18*a* so that the handle is flush with the upper surface when the handle is seated in the receptacle seat whereat the handle is resting on the floor 38 thereof at an orientation parallel with the upper surface. The handle 32 is connected pivotally to the platform member 16 at the receptacle seat 34, such as for example by pins 40 which pass through a base portion of the handle and into the platform member at opposing sides of the receptacle seat. A grip recess 40 may be provided in the floor 38 of the receptacle seat 34 so that a user can place one or more fingers under the handle 32 to pivot the handle away from the floor. When the lid 10 is carried, pulled off from the mouth, or placed upon the mouth, the handle is pivoted to an orientation perpendicular with respect to the upper surface 16*a*.

Integrally connected with the under side 18*b* of the platform member 16, is the aforementioned interface member 22. The interface member 22 is preferably in the form of a rim 44 which depends substantially perpendicularly from the under side 18*b*. The rim 44 is shaped to form fit with respect to the sidewall 24 at the mouth 12 in a manner similar to a conventional lid as hereinabove described. However, the rim 44 is preferred to be structured to interface with the refuse container so that a firm and stable interfit therebetween is provided. A firm and stable interfit is important to ensure that if an object is placed onto the upper side 18*a* at the overhang portion 26 thereof, the lid 10 will not tippingly pop-off from the refuse container 14. Accordingly, it is preferred for the rim 44 to be in the form of a continuous loop which follows the shape of the sidewall 24 at the mouth 12 so that a tight interface is provided with the sidewall 24. Alternatively, the rim may be in the form of discretely arranged segments rather than a continuous loop.

Figure 2:
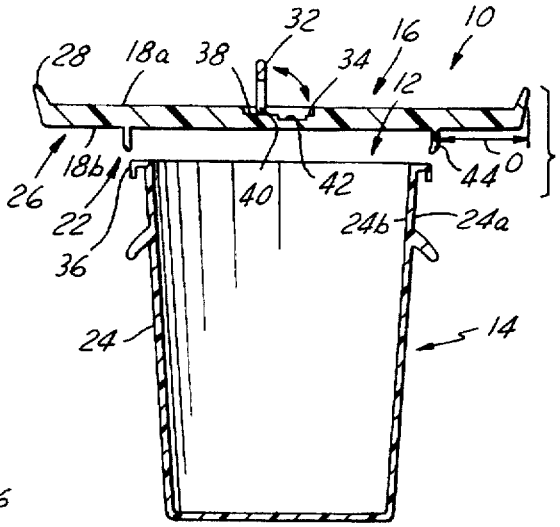
FIG. 2 is an exploded sectional side view of the lid according to the present invention and a refuse container having a mouth which the lid is intended to cover.
Figure 3:
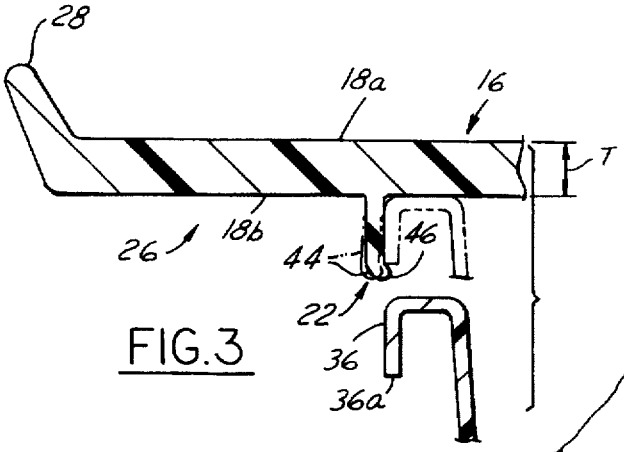
FIG. 3 is a detail sectional side view of the interface member of the lid according to the present invention adjacent the mouth of a refuse container.
Figure 4:
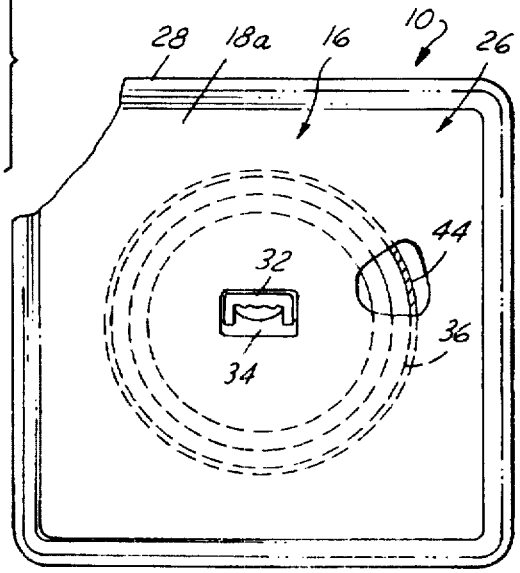
FIG. 4 is a top plan elevational view of the lid according to the present invention, shown operatively disposed covering the mouth of a refuse container.
Figure 5:
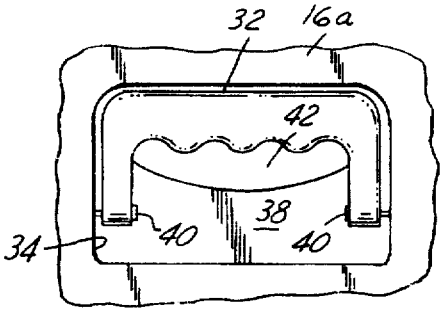
FIG. 5 is a detail plan view of the lid according to the present invention, showing the handle thereof.

Preferably, the rim 44 is provided with one or more nibs 46 which snappingly interface with one or more surfaces of the sidewall 24. As shown at FIGS. 2 and 3, a preferred interface between the refuse receptacle 14 and the lid 10 is via a rim 44 having a rounded nib 46 which snaps over a terminal surface 36*a* of a U-shaped top 36 of the sidewall. It is to be understood that other interface structures are envisionable by those having ordinary skill in the art, and that the above described and depicted interface structure is by way of preferred example only. For example another preferable interface between the lid 10 and a refuse container is via a first nib of the rim of the lid snappingly interfacing with a second nib of the sidewall of the refuse container, wherein the second nib is wedge shaped, defined by increasing relief with increasing distance from the mouth. Further for example, the rim may interface at the outside 24*a* of the sidewall 24, at the inside 24*b* of the sidewall, or be slotted to receive therein the sidewall at the mouth.

In operation, the user grasps the handle and places the lid 10 onto a refuse container coveringly over the mouth thereof. The user then presses downwardly on the upper surface of the platform member to thereby cause the interface member to engage the sidewall of the refuse container. Now the upper surface is usable as a work platform. When no longer needed as a work platform, the lid 10 is pulled off from the refuse container, wherein in the process of carrying, articles laying on the upper surface may be transported therewith. The lid 10 may be used as a refuse container when the mouth thereof is not covered. The lid 10 may serve as its cover, or, attendently, a conventional lid of the refuse container is used to cover the mouth when refuse is present therein, especially when garbage pick-up is to ensue.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A lid for interfitting with a sidewall of a refuse container so as to cover a mouth thereof, said lid comprising:

a substantially planar, rigid platform member having an upper surface and an opposite lower surface, said platform member having a periphery, said periphery having a first cross-section; and interface member means for interfitting with a sidewall of a refuse container at the mouth thereof to thereby cover the mouth and provide a work platform at said upper surface of said platform member;

wherein said interface member means has a second cross-section, said first cross-section being larger than said second cross-section which thereby defines an overhang of said platform member with respect to the sidewall of the refuse container at the mouth thereof;

wherein said overhang is substantially at least one inch all around said periphery.

2. The lid of claim 1, further comprising handle means connected with said platform member for providing a carrying handle.

3. The lid of claim 2, wherein said handle means comprises:

a receptacle seat formed in said upper surface of said platform member;

a handle; and pivot means for pivotally connecting said handle to said platform member at said receptacle seat, wherein said handle is flush with said upper surface when received in said receptacle seat.

4. The lid of claim 1, further comprising a raised lip located at said periphery of said upper surface.

5. The lid of claim 1, wherein said interface member means comprises a rim depending from said lower surface of said platform member; wherein said rim interfits with respect to the sidewall of the refuse container to thereby secure said platform member coveringly at the mouth of the refuse container.

6. The lid of claim 1, wherein said rim has at least one nib for providing a snapping interfit with the sidewall of the refuse container.

7. The lid of claim 1, wherein said overhang is substantially at least six inches.

8. A lid for interfitting with a sidewall of a refuse container so as to cover a mouth thereof, said lid comprising:

a rigid, substantially planar platform member having a substantially flat upper surface and an opposite lower surface, said platform member having a periphery, said periphery having a first cross-section;

handle means pivotally connected with said upper surface of said platform member for providing a carrying handle, wherein said handle means comprises:

a receptacle seat formed in said upper surface of said platform member;

a handle; and pivot means for pivotally connecting said handle to said platform member at said receptacle seat, wherein said handle is flush with said upper surface when received in said receptacle seat; and interface member means for interfitting with a sidewall of a refuse container at the mouth thereof to thereby cover the mouth and provide a work platform at said upper surface of said platform member;

wherein said interface member means has a second cross-section, said first cross-section being larger than said second cross-section which thereby defines an overhang of said platform member with respect to the sidewall of the refuse container of the mouth thereof; and wherein said overhang is substantially at least one inch all around said periphery.

9. The lid of claim 8, further comprising a raised lip located at said periphery of said upper surface.

10. The lid of claim 9, wherein said interface member means comprises a rim depending from said lower surface of said platform member; wherein said rim interfits with respect to the sidewall of the refuse container to thereby secure said platform member coveringly at the mouth of the refuse container.

11. The lid of claim 10, wherein said rim has at least one nib for providing a snapping interfit with the sidewall of the refuse container.

12. The lid of claim 11, wherein said overhang is substantially at least eight inches.

13. A lid and refuse container comprising:

a refuse container having a sidewall defining a closed bottom and an opposite open mouth;

a lid comprising:

a rigid, substantially planar platform member having an upper surface and an opposite lower surface, said platform member having a periphery, said periphery having a first cross-section; and interface member means for interfitting with said sidewall of said refuse container at said mouth thereof to thereby cover said mouth and provide a work platform at said upper surface of said platform member;

wherein said interface member means has a second cross-section, said first cross-section being larger than said second cross-section which thereby defines an overhang of said platform member with respect to said sidewall of said refuse container at said mouth thereof;

wherein said overhang is substantially at least one inch all around said periphery.

14. The lid and refuse container of claim 13, further comprising handle means pivotally connected with said platform member for providing a carrying handle.

15. The lid and refuse container of claim 14, wherein said handle means comprises:

a receptacle seat formed in said upper surface of said platform member;

a handle; and pivot means for pivotally connecting said handle to said platform member at said receptacle seat, wherein said handle is flush with said upper surface when received in said receptacle seat.

16. The lid and refuse container of claim 15, further comprising a raised lip located at said periphery of said upper surface.

17. The lid and refuse container of claim 16, wherein said overhang is substantially at least six inches.

18. The lid and refuse container of claim 7, wherein said interface member means comprises a rim depending from said lower surface of said platform member; wherein said rim and said sidewall are structured to mutually snappingly interfit to thereby secure said platform member coveringly at said mouth.

* * * * *